United States Patent [19]

Fealey et al.

[11] Patent Number: 4,585,154

[45] Date of Patent: Apr. 29, 1986

[54] FASTENER DRIVING TOOL WITH ADJUSTABLE THREE-PART MAGAZINE CANISTER ASSEMBLY

[75] Inventors: William S. Fealey, Jamestown; Prudencio S. Canlas, North Kingstown, both of R.I.

[73] Assignee: Bostitch Division of Textron Inc., Providence, R.I.

[21] Appl. No.: 593,297

[22] Filed: Mar. 26, 1984

[51] Int. Cl.[4] ..... B25C 1/00; B25C 1/04; B25C 7/00

[52] U.S. Cl. ..... 227/109; 227/128; 227/136; 227/120

[58] Field of Search ..... 227/109, 128, 136, 120

[56] References Cited

U.S. PATENT DOCUMENTS

| | | | |
|---|---|---|---|
| 3,259,292 | 7/1966 | Maynard | 227/136 X |
| 3,330,462 | 7/1967 | Colechia et al. | 227/136 |
| 3,450,255 | 6/1969 | Mosetich | 206/56 |
| 3,543,987 | 12/1970 | Obergfell | 227/136 |
| 3,558,031 | 1/1971 | Hillier | 227/7 |
| 3,568,908 | 3/1971 | Bader | 227/127 |
| 3,688,966 | 9/1972 | Perkins et al. | 227/127 |
| 3,945,551 | 3/1976 | Sato et al. | 227/136 |
| 4,319,705 | 3/1982 | Geist et al. | 227/120 |
| 4,518,109 | 5/1985 | Shiroyama | 227/109 |

FOREIGN PATENT DOCUMENTS

| | | | |
|---|---|---|---|
| 57-51810 | 11/1982 | Japan | 227/109 |

*Primary Examiner*—Robert L. Spruill
*Assistant Examiner*—Taylor J. Ross
*Attorney, Agent, or Firm*—Cushman, Darby & Cushman

[57] ABSTRACT

A fastener driving tool with an improved fastener package supporting magazine canister assembly constructed essentially of three plastic parts: (1) a mounting part, (2) a package supporting part, and (3) a package covering part. A plurality of ledges on the exterior periphery of a portion of a peripheral wall of the supporting part and series of cooperating ledges on the mounting part act as an adjustable mount for releasably fixedly supporting the package supporting part on the mounting part in a selected one of a plurality of different operative positions depending upon the nail size of the package which is selected. A movable connection serves to support the package covering part on the mounting part for movement between (1) an operative position overlying the bottom wall of the package supporting part in any of its selected operative positions so as to contain the corresponding selected package in point supported relation on the bottom wall and within the peripheral confinement of the peripheral wall of the package supporting part, and (2) an access position wherein the space overlying the bottom wall is sufficiently open to permit movement of a package into point supported relation to the bottom wall within the peripheral wall of the package supporting part. A releasable lock is provided for releasably locking the package covering part in its operative position.

15 Claims, 10 Drawing Figures

Fig. 2.
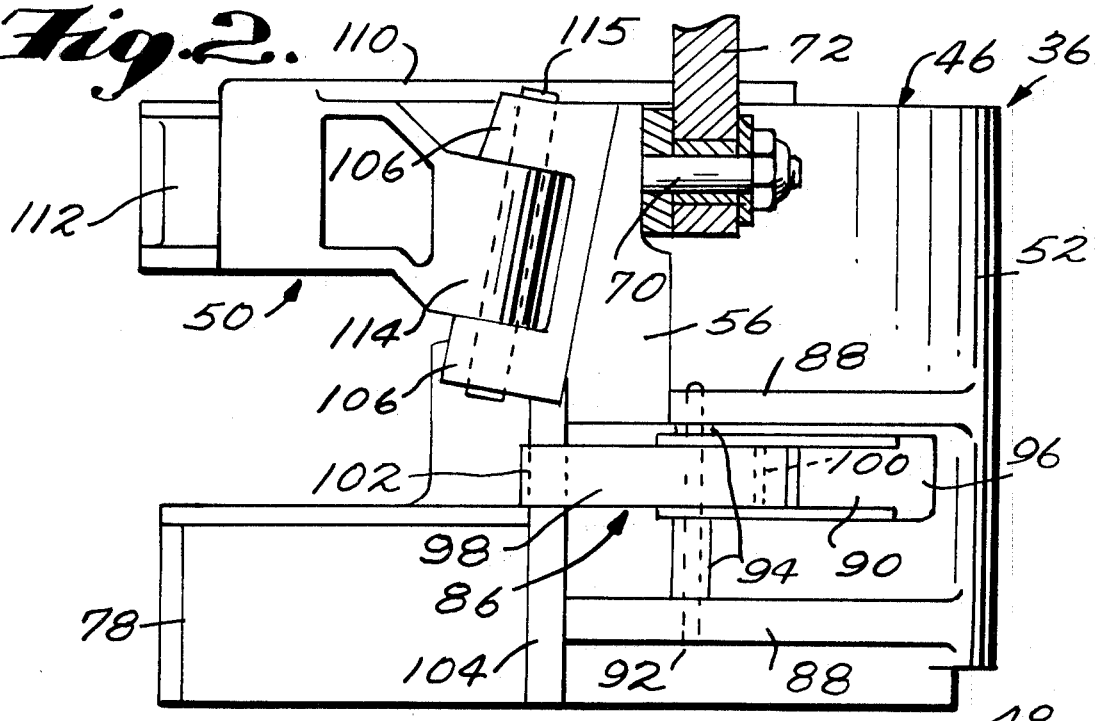
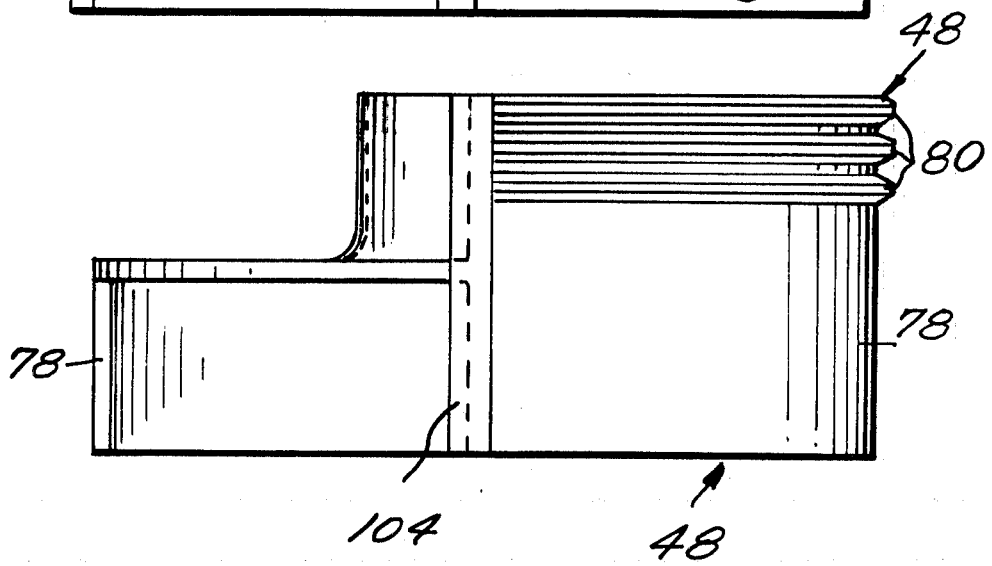
Fig. 9.

FASTENER DRIVING TOOL WITH ADJUSTABLE THREE-PART MAGAZINE CANISTER ASSEMBLY

This invention relates to fastener driving tools and, more particularly, to improvements in the magazine canister assembly embodied in tools of this type for containing coiled fastener packages of different sizes.

A typical magazine canister assembly to which the improvements of the present invention relate is disclosed in commonly assigned U.S. Pat. No. 3,330,462 and consists essentially of three sheet metal parts. Two of the parts are hingedly connected together for movement between a closed operative position and an open access position. In the closed operative position, the two hinged parts provide an essentially enclosed cylindrical container. The third part constitutes a movable bottom wall which is mounted for axial adjustment to accommodate different fastener packages, in which the fastener size varies from one package to the other. The means for adjusting the axial position of the bottom wall extends between the movable bottom wall part and the bottom wall provided by one of the hinged parts.

The canister assembly disclosed in the above patent has proven to be satisfactory in operation. One problem which is encountered with this construction is that the range of adjustment provided is relatively small so that it is not possible for one canister construction to accommodate as many as three or four different size tools. One reason for this lack of accommodation of different size tools is that the overall size of the canister assembly is fixed even though the bottom wall is adjustable to accommodate some variation in the nail size in the fastener packages received therein.

There have been other proposals for adjustable canister assemblies in which the overall size of the canister assembly is adjusted in accordance with the adjustment provided for the fastener package size. This type of adjustable canister assembly is disclosed in U.S. Pat. Nos. 3,568,908 and 3,688,966. The arrangement disclosed in these two patents includes the provision of a bottom wall having a peripheral wall extending upwardly from a substantial portion of the peripheral edge thereof. This canister part is adjustably mounted to accommodate the fastener package by securing the same in different positions of adjustment with respect to a fixed central spindle or post.

While this arrangement provides a measure of overall canister assembly size adjustment commensurate with size of fastener package accommodated, here again the range of size accommodated is quite limited and the ease and simplicity of replenishing the fastener package supply is greatly complicated. With this arrangement when it becomes necessary to provide a new fastener package, the entire bottom wall part must be disengaged and removed from the fixed spindle and then replaced back into its proper position of adjustment. In addition, it will be noted that the fixed spindle or central post of the arrangement clearly limits the overall size reduction which can be secured within the limited adjustment range provided.

It is an object of the present invention to provide a canister assembly which achieves the advantages of both types of prior art assemblies described above while eliminating the disadvantages thereof and providing the capaiblity of a greater range of adjustment. In accordance with the principles of the present invention, this objective is achieved by providing a canister assembly which is constructed essentially of three parts, each of which is preferably molded of plastic material. The three parts include a mounting part, a packaging supporting part, and a package covering part, all of which are adjustably interrelated with respect to one another so as to contain a selected one of a series of coiled fastener packages in which the fasteners of each coiled package are of incrementally different lengths with respect to the remaining packages of the series. The mounting part is suitably fixed to the tool housing, and the package supporting part includes a generally circular fastener point engaging bottom wall and an integral peripheral wall extending in an axial direction from a substantial portion of the exterior periphery of the bottom wall. An adjustable mount acts between the exterior periphery of a portion of the peripheral wall and the mounting part for releasably fixedly supporting the package supporting part on the mounting part in a selected one of a plurality of different operative positions depending upon the nail size of the package which is selected. The operative positions of the package supporting part are displaced with respect to the mounting part in an axial direction in parallel relation to itself. A movable connection serves to support the package covering part on the mounting part for movement between (1) an operative position overlying the bottom wall of the package supporting part in any of its selected operative positions so as to contain the corresponding selected package in point supported relation on the bottom wall and within the peripheral confinement of the peripheral wall of the package supporting part, and (2) an access position wherein the space overlying the bottom wall is sufficiently open to permit movement of a package into point supported relation to the bottom wall within the peripheral wall of the package supporting part. A releasable lock is provided for releasably locking the package covering part in its operative position.

Preferably, the adjustable mount comprises a series of axially spaced concavely arculately extending supporting ledges formed on the mounting part and a plurality of spaced convexly arcuately extending supporting ledges formed on the peripheral wall of the package supporting part. Preferably, the ledges have a cross-sectional configuration similar to meshing gear teeth so as to enable the plurality of ledges of the package supporting part to be operable to be selectively intermeshed between any corresponding plurality of ledges among the series of ledges on the mounting part.

Preferably, the ledges are maintained in selected intermeshing relation by abutments adjacent one end of the ledges engaging with cooperating receses and a latch carried by one of the parts adjacent the opposite end of the ledges releasably engaging with a cooperating axially extending latch receiving surface formed on the other part at the adjacent end of the ledges thereof. By properly positioning the abutments with respect to the latch, which is preferably an overcenter spring press toggle latch, the package supporting part is made to separate from the other two parts when the canister assembly is subject to unwanted impact forces, as, for example, when the tool is accidentally dropped. The function of separation is highly desirable in the larger size fastener packages because the greater weights encountered can cause damage to the parts if the tool is accidentally dropped, as for example, fracture of plastic parts or permanent deformation of metal parts.

Another object of the present invention is the provision of a canister assembly of the type described which is effective in operation over a wide range of adjustment, lightweight and simple in construction, and economical to manufacture.

These and other objects of the present invention will become more apparent in the course of the following detailed description and appended claims.

The invention may best be understood with reference to the accompanying drawings wherein an illustrative embodiment is shown.

In the drawings:

FIG. 2 is a rear elevational view of the canister assembly showing the rearward connection thereof to the tool housing in-cross section.

FIG. 9 is a rear elevational view of the package supporting part of the canister assembly.

Figure 1:
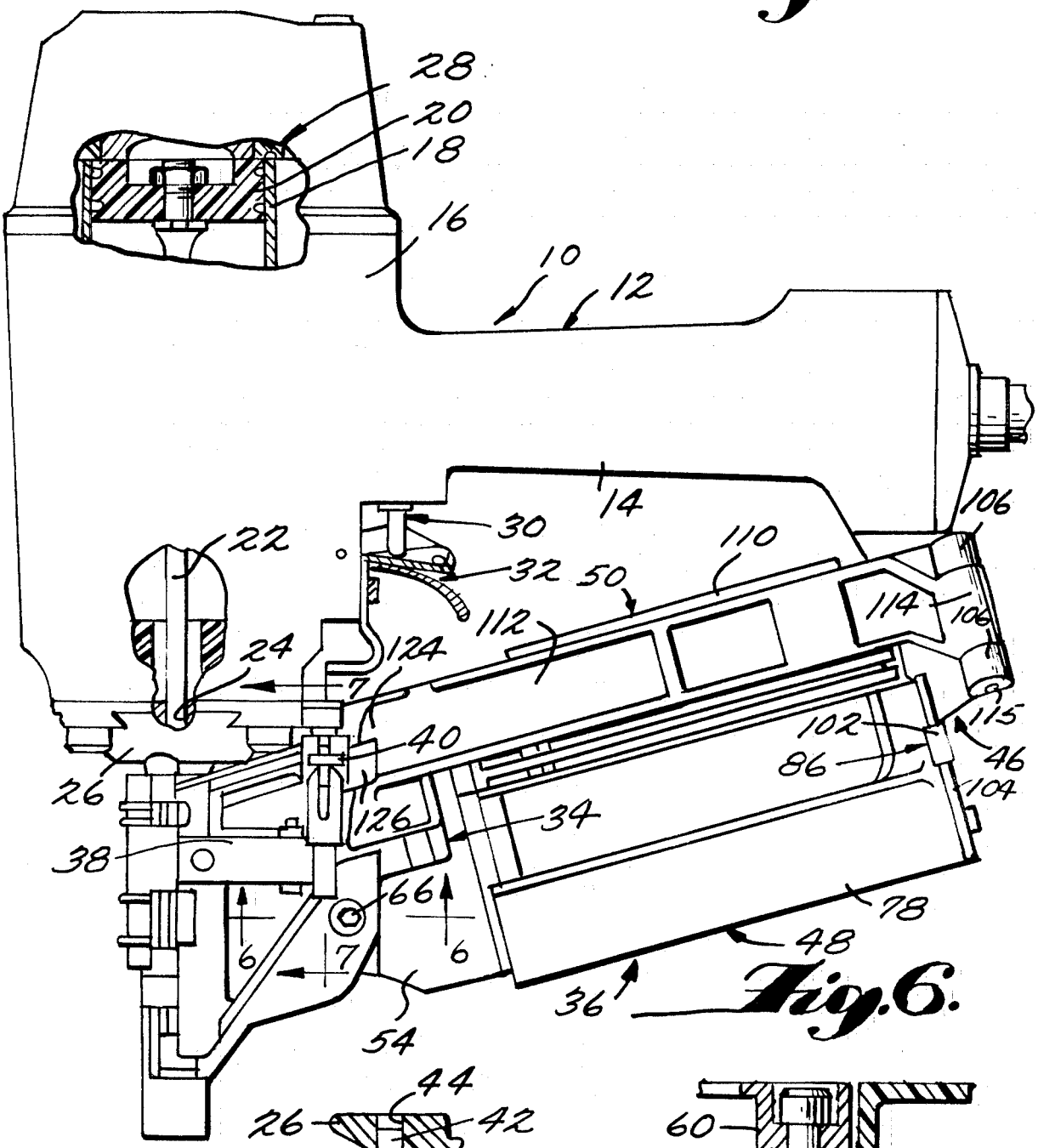
FIG. 1 is a side elevational view with parts broken away for purposes of clearer illustration of a fastener driving tool embodying a canister assembly constructed in accordance with the principles of the present invention.

Referring now more particularly to FIG. 1 of the drawings, there is shown therein a portable pneumatically operated fastener driving tool, generally indicated at 10, which embodies the improvements constructed in accordance with the principles of the present invention. As shown, the tool 10 includes a portable rigid housing assembly, generally indicated at 12, which provides a handle portion 14 and a driving cylinder containing portion 16 extending generally at a right angle at the forward end of the handle portion 14. In accordance with conventional practice, a cylinder 18 is mounted within the housing portion 16, within which is slidably mounted a driving piston 20. A fastener driving element 22 is fixed to the driving piston and extends within a driving track 24 formed in a nose piece 26, forming a part of the housing assembly 12 in a fixed position below the portion 16. In accordance with conventional practice, the handle portion 14 contains a reservoir (not shown) for receiving a source of air under pressure which is communicated with the upper end of the cylinder 18 by a pilot pressure operated main valve assembly 28. The pilot pressure operated main valve assembly 28 is under the control of a trigger valve assembly 30 operated by a trigger assembly 32 in accordance with conventional procedures. The nose piece 26 includes a ratchet type fastener feeding mechanism, generally indicated at 34, which is operable to cooperate with a leading end portion of a coiled fastener package contained within a canister assembly, generally indicated at 36, which embodies the principles of the present invention.

It will be understood that the components other than the magazine canister assembly 36 are illustrative only and that they may be of any known equivalent construction. The components other than the canister assembly 36 are exemplarily of the type disclosed in U.S. Pat. No. 3,945,551, the disclosure of which is hereby incorporated by reference into the present specification.

Likewise, the coiled fastener packages utilized with the tool may be of any known construction. However, a preferred embodiment is disclosed in co-pending application Ser. No. 558,533, filed Dec. 6, 1983, the disclosure of which is hereby incorporated by reference into the present specification. The fastener package disclosed in the aforesaid co-pending application is made up of a series of headed nails interconnected in an array by a pair of parallel wires welded to the shanks of each nail in the array so as to maintain them in substantially parallel relation. The array of nails is then wound into a coil formation in which the heads of alternate convolutes are disposed in overlapped and underlapped relation with respect to the heads of the preceding convolutes so as to present pointed and headed ends of the coiled package which are substantially flat. Other types of flat coiled fasteners herein contemplated are disclosed in U.S. Pat. Nos. 3,450,255, 3,543,987, 3,558,031 and 4,319,705.

The fastener feeding mechanism 34 includes a swingable door 38 which carries the holding pawl assembly (not shown) of the feeding mechanism. The holding pawl assembly serves to engage the rearward surface of a leading nail of the package so as to prevent rearward movement thereof when the feeding pail assembly (also not shown) is moved through its rearward return stroke after its forward feed stroke has been accomplished. A detailed understanding of the operation of the fastener feeding mechanism 34 and its cooperation with the operation of fastener driving element 22 is not believed essential to a full understanding of the canister assembly improvements of the present invention. For an understanding of these operative details, reference may be made to the specification of the aforesaid U.S. Pat. No. 3,945,551. For present purposes, it is sufficient to note that the swingable door 38 carries a releasable latch mechanism 40 providing a keeper bolt 42 which is adapted to engage within an opening 44 in the tool housing 12 so as to maintain both the fastener feeding mechanism 34 and the canister assembly 36.in their closed operative positions.

As best shown in FIGS. 1 through 5, the canister assembly 36 is formed essentially of three molded plastic parts including a mounting part, generally indicated at 6, a fastener package supporting part, generally indicated at 48, and a fastener package covering part, generally indicated at 50. It will be understood that any suitable plastic material may be utilized to form the molded parts 46, 48 and 50. An exemplary preferred material is Zytel®, manufactured by DuPont. Specifically, the parts 46 and 48 are FE 8018 (14% glass) and the part 50 is ST 801 or ST 800.

Figure 6:
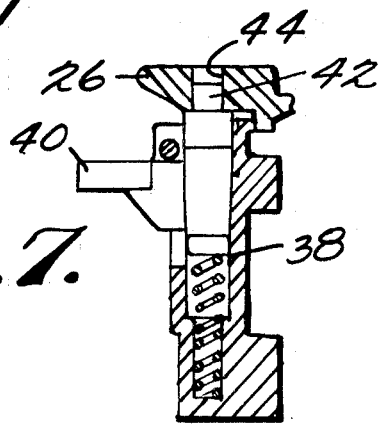
FIG. 6 is an enlarged fragmentary sectional view taken along the line of 6—6 of FIG. 1 showing the forward connection between the canister assembly and the tool housing.
Figure 7:
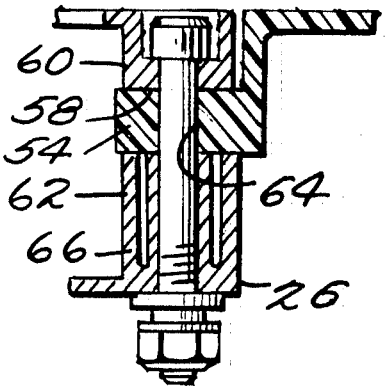
FIG. 7 is an enlarged fragmentary sectional view taken along the line of 7—7 of FIG. 1 showing the latch mechanism for releasably retaining the canister assembly parts in their closed operative position.
Figure 3:
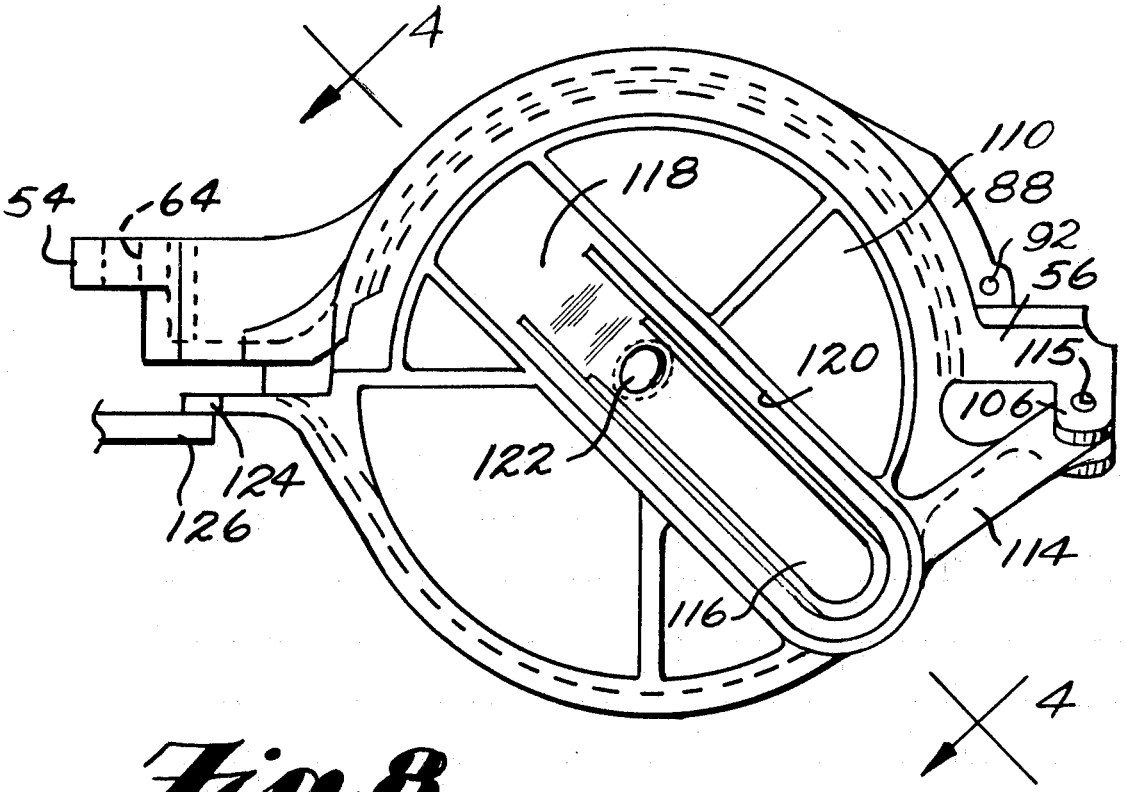
FIG. 3 is a top plan view of the canister assembly.
Figure 8:
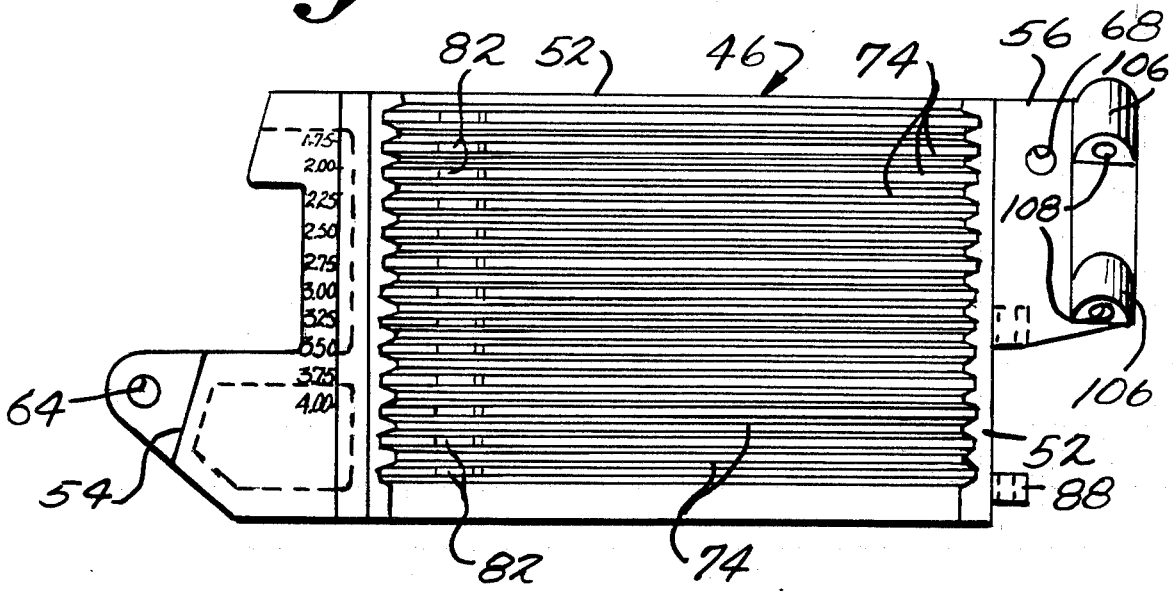
FIG. 8 is a side elevational view of the mounting part of the canister assembly.

As best shown in FIG. 8, the mounting part 46 is essentially in the form of a semi-cylindrical wall 52 having a forward mounting lug 54 extending forwardly from the lower exterior forward edge thereof and a rearward mounting lug 56 extending rearwardly from the upper exterior rearward edge thereof As best shown in FIG. 6, the forward extremity of the forward mounting lug 54 is laterally offset to engage within a space 58 defined between aligned portions 60 and 62 of the nose piece 26. As shown, the offset portion of the mounting lug 54 is apertured, as at 64, to receive a securing bolt assembly 66 therethrough which also passes through suitable openings in the spaced portions 60 and 62.

As best shown in FIG. 8, the rearward mounting lug 56 is also formed with an opening 68 to receive a mounting bolt assembly 70 which likewise extends through a depending integral portion 72 of the tool housing 12 disposed below the rearward end of the handle portion 14 thereof. It will be understood that the bolt assemblies 66 and 70 serve to fixedly secure the mounting part 46 of the canister assembly 36 with the rigid tool housing 12.

Still referring to FIG. 8, it will be noted that the main semi-cylindrical wall 52 of the mounting part 46 has formed integrally on the interior surface thereof a series of supporting ledges 74 which extend concavely arcuately for an angular extent of approximately 170°. The fastener package supporting part 48 is formed with a bottom wall 76 of generally circular configuration, having a peripheral wall 78 extending axially from the peripheral edge thereof through a substantial extent thereof, as, for example, approximately 340°. Preferably, a substantial portion of the peripheral wall 78, as for example, approximately 180° thereof, has an axial extent greater than the remainder. Formed on the upward axial extension of the peripheral wall 78 on the exterior surface thereof is a plurality of convexly arcuately extending supporting ledges 80. The cross-sectional configuration of the ledges 80 are complementary with respect to the cross-sectional configuration of the supporting ledges 74 so that the two may be brought together in intermeshing relation somewhat similar to the intermeshing relationship between gear teeth, although, the contact between the ledges is preferably through the entire radial extent thereof rather than along a line.

Figure 4:
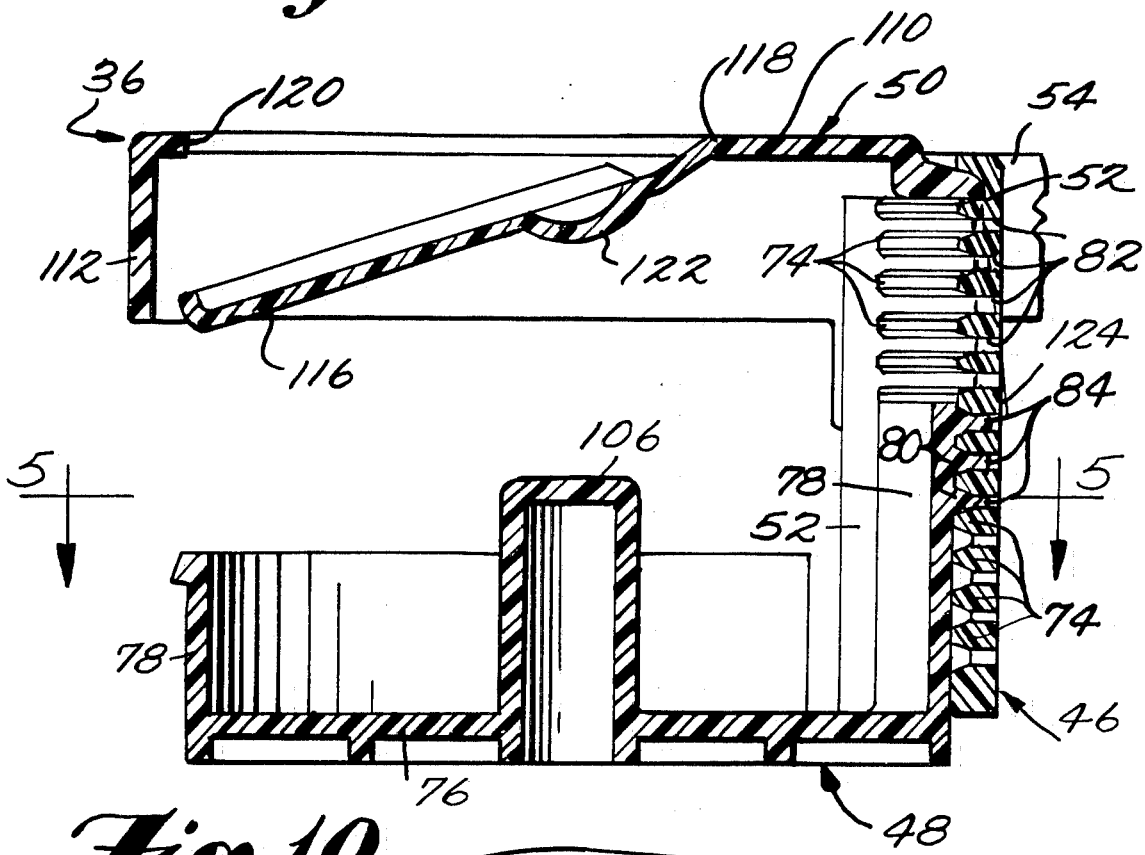
FIG. 4 is a cross-sectional view taken along the line 4—4 of FIG. 3.
Figure 10:
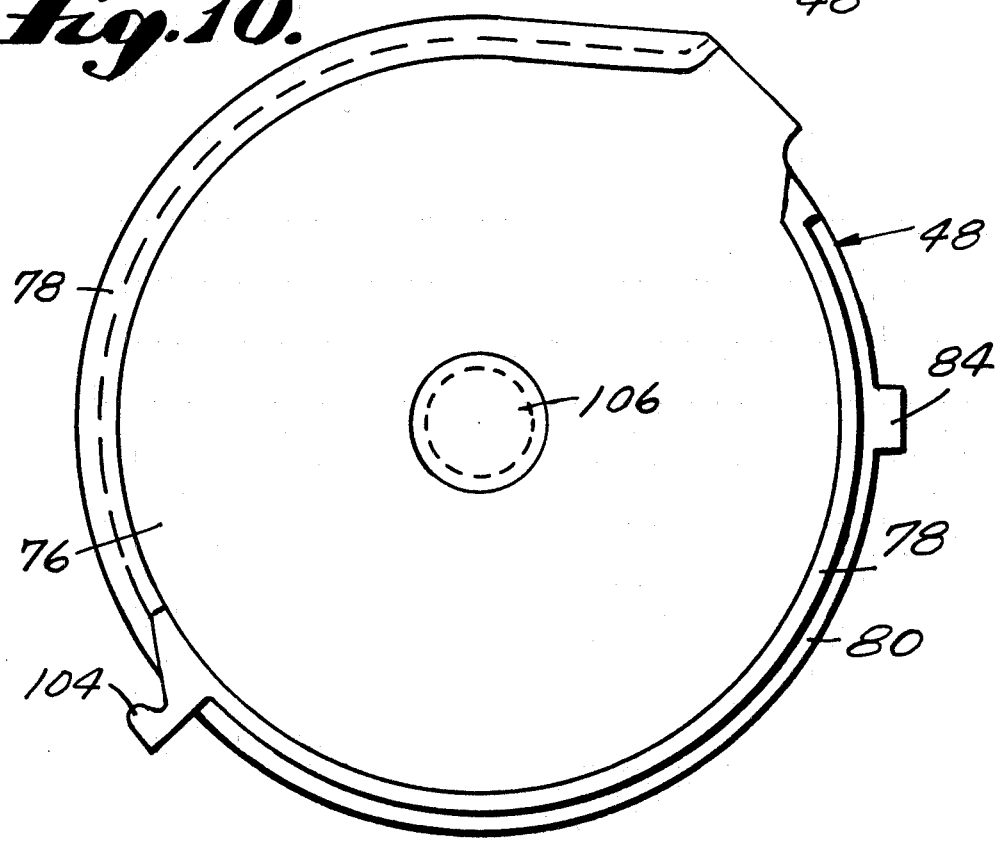
FIG. 10 is a top plan view of the package supporting part shown in FIG. 9.

As can be seen from FIG. 4, the series of supporting ledges 74 on the mounting part 46 may exemplarily be twelve whereas the plurality of supporting ledges 80 on the fastener package supporting part 48 is exemplarily three. With this arrangement, the three ledges 80 are capable of intermeshing with the series of twelve ledges 70 in any one of 10 incrementally spaced axial positions. As shown in FIG. 8, the 10 different positions are provided with indicia of from 1.75 to 4.00 in 0.25 increments which indicia corresponds with the length of shanks included within the fasteners forming the series of coiled fastener packages selected to have their point ends supported on the upwardly facing surface of the bottom wall 76. In FIG. 4 the fastener package supporting part 48 is shown with its pluraliy of supporting ledges intermeshed with intermediate ledges 74 within the series provided on the mounting part 46.

In order to retain the fastener package supporting part 48 in any selected position of adjustment with respect to the mounting part 46, the peripheral wall 52 of the mounting part is formed with a series of recesses or openings 82 at positions between adjacent supporting ledges 74 spaced closely from one of the ends thereof. Formed on each of the cooperating supporting ledges 80 is an abutment 84 of a size to enter within the opening or recess 82. It will be noted that the angular position of the abutments 84 enable the same to be readily engaged within the associated openings or recesses 82 prior to the movement of the associated supporting ledges into their full intermeshing relationship. The angular position of the abutments 84 are such as to prevent disengagement from the recesses 82 in response to a circumferential translational movement of the fastener package supporting part 48 with respect to the mounting part 46 from its full intermeshing position. Consequently, by providing a releasable latch which prevents such movement, the combination of the engagement of the abutments 82 within the recesses 82 and the securement of the latch will serve to fixedly retain the fastener package supporting part 48 in any of its selected positions of adjustment with respect to the mounting part 46. While any suitable latch mechanism may be utilized, as shown, a toggle latch assembly, generally indicated at 86, is preferably carried by the mounting part 46 for cooperative releasable engagement with the fastener package supporting part 48.

Figure 5:
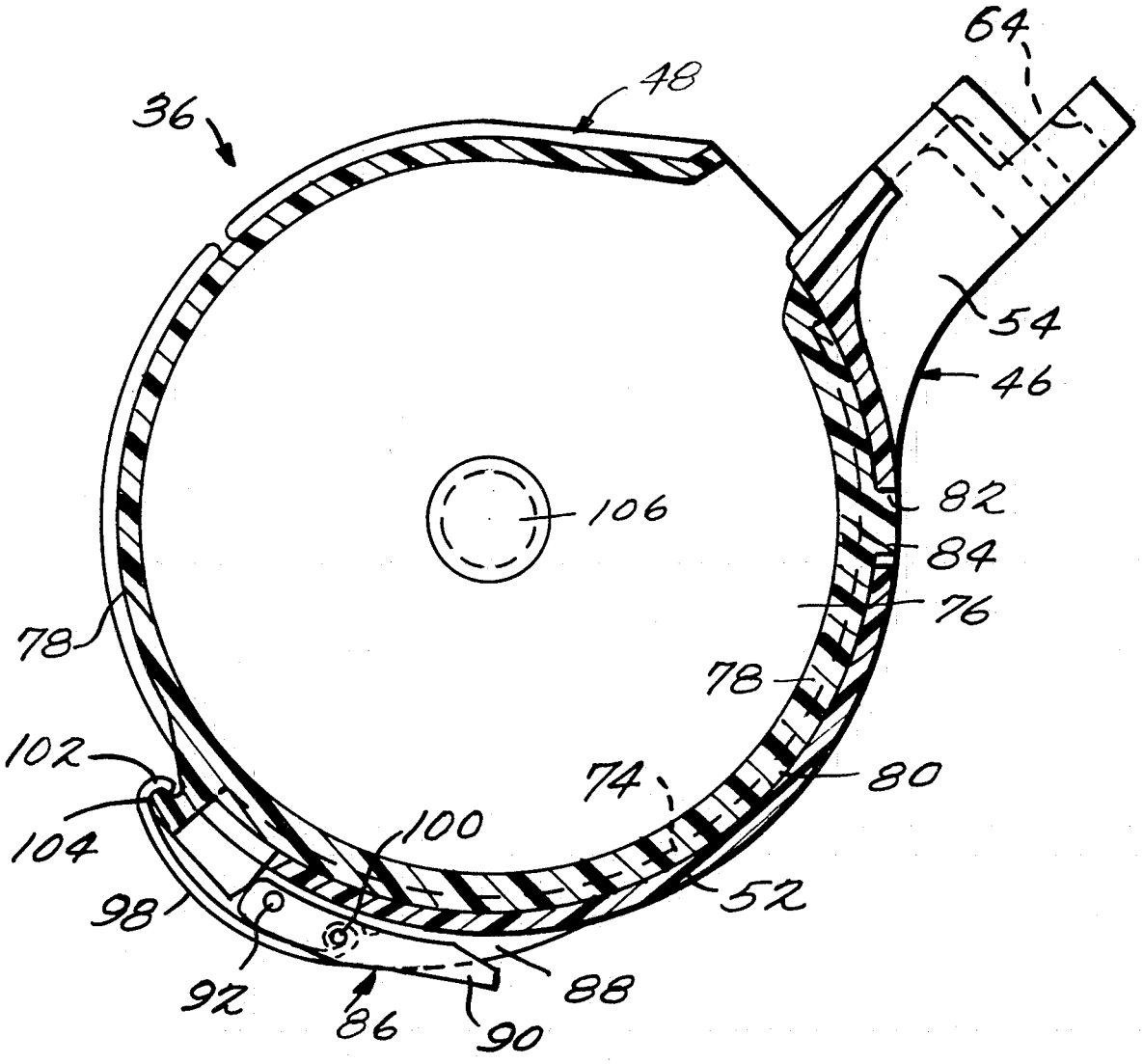
FIG. 5 is a sectional view taken along the line 5—5 of FIG. 4.

As best shown in FIGS. 2 and 5, the exterior of the peripheral wall 52 of the mounting part 46 is formed with a pair of axially spaced angularly extending ribs 88. The toggle latch assembly 86 includes a first latch member 90 of generally U-shaped cross-sectional configuration, having apertures formed in one end thereof for receiving a pivot pin the ends of which are suitably engaged within the ribs 88. Spacer sleeves 94 are preferably provided on opposite sides of the pivotal connection of the first latch member 90 with the pivot pin 92. The opposite end of the first latch member 90 constitutes a manually engageable end 96 and the toggle latch assembly 86 also includes a second latch member 98 which is pivoted, as by a pivot pin 100, at one of its ends to the first latch member 96 intermediate the ends of the latter. The opposite end of the second latch member 98 is formed into a hooked configuration, as indicated at 102, for cooperative securement with an axially extending latch engaging element 104 formed integrally on the part 48 in radially outwardly extending relation from the exterior surface of the peripheral wall 78 at a position adjacent the ends of the associated plurality of ledges 80.

As best shown in FIG. 5, the latch engaging element 104 is of constant cross section throughout its axial extent and is preferably of hooked shaped configuration to cooperatively receive the hooked shaped end 102 of the second latch member 98. Also as shown in FIG. 5, the second latch member 98 between its ends is outwardly bowed so as to provide the same with a degree of resilient extension between its ends so that when the latter are extended apart a bias is imposed between the ends tending to move them toward one another. It can thus be seen that the toggle latch assembly 86 operates in generally conventional fashion similar to the toggle latches provided on suitcases or valises.

The package supporting part 48, in addition to the circular bottom wall 76 and the peripheral wall 78, also includes an integral center post 106 which extends axially upwardly from the center of the circular bottom wall 76 for engagement within the open core of the coiled fastener package so as to enable the main body of the coiled fastener package to turn or rotate about the center post as the leading portion is moved outwardly in a generally lateral or tangential direction by the fastener feeding mechanism 34.

As best shown in FIGS. 1-3 and 8, the rearward mounting lug 56 of the mounting part 46 extends beyond the mounting aperture 68 and has formed integrally thereon a pair of spaced hinge elements 106. As shown, the hinge elements are formed with aligned apertures 108 which have a common axis extending at an angle with respect to a perpendicular plane passing through the axis of the semi-cylindrical wall 52. The angular extent of the axis is exemplarily approximately 10°.

The fastener package covering part 50 includes a top wall 110 which is of generally circular configuration of a size to overlay the package supporting part 48 including the bottom wall 76 and the peripheral wall 78 thereof. Extending downwardly from the top wall along a portion of its periphery is a relatively short peripheral wall 112. The peripheral wall has an angular extent of slightly less than 180°. Extending generally tangentially from the rearward end thereof is a hinge element 114 of a size to engage between the hinge elements 106 of the mounting part 46. The hinge element 114 is centrally apertured to receive a pivot pin 115 which also extends through the aligned openings 108 in the hinge elements 106. The angular relationship of the pivot pin 116 with respect to a plane passing through the axis of the central post 106 has the effect of enabling the fastener package covering part 50 to move between a closed normal operating position wherein the top wall 110 thereof is disposed in spaced aligned relation with respect to the bottom wall 76 of the fastener package supporting part 48 and an open access wherein the space overlying the bottom wall 76 is sufficiently open to permit movement of a fastener package into point supported relation to the bottom wall within the peripheral wall 76 with the open core fitted over the central post 106.

It will be noted that during the pivotal movement of the fastener package covering part 50 from its closed normal operative position into its open access position, the top wall 110 and peripheral wall 112 thereof will move upwardly and laterally away from the bottom wall 76 and peripheral wall 78 of the package supporting part 48. This upward component of movement is important in that it accommodates a flexure or stress of a fastener package holding spring 116. As best shown in FIG. 4, the spring 116 is preferably formed as an integral portion of the fastener package covering part 50. The spring 116 is in the form of a generally flat peripherally ribbed rectangular tongue which is integrally connected, as at 118, at one end with the top wall 110. As shown, the spring 116 is molded so as to normally extend downwardly from the hinged connection 118 below the surface of the top wall. Since the part 50 constitutes a single molding, the top wall 110 is formed with a die receiving opening 120 in a position above the spring 116.

In the normal operation of the spring 116, when the part 50 is moved inwardly and downwardly into its closed position, the bottom surface of the spring will move into engagement with the headed end of the fastener package and be resiliently deflected upwardly as the part 50 is moved into its fully closed operative position. The spring 116 thus serves to normally apply a force on the upper headed end of the fastener package biasing the pointed end into engagement with the upper surface of the bottom wall. The portion of the spring 116 which overlies the central post 106 when the part 50 is in its closed position is formed with an inverted dome-like depression 122, which is adapted to engage within the upper open end of the core of the fastener package so as to cooperate with the central post 106 in guiding the coiled fastener package and rotational movement about its axis as the leading portion is paid out by the operation of the fastener feeding mechanism 34.

Finally, it will be noted that the end of the peripheral wall 112 opposite from the hinge element 114, is formed with a downwardly extending locking portion 124. This locking portion is disposed in a position to be engaged by a locking portion 126 of the door member 38 when the part 50 is in its closed operative position and the door is likewise disposed in its closed operative position. Release of door latch bolt 42 not only releases the door 38 for movement into its open access position, but the fastener package covering part 50 of the canister assembly 36 as well.

It can be seen that the canister assembly 36 of the present invention provides an effective structure for containing and supporting a coiled fastener package which is not only lightweight but of relatively inexpensive cost. The assembly is made up of essentially three molded plastic parts (46, 48 and 50), two of which (46 and 50) are hinged together for movement between open and closed positions and two of which (48 and 50) are adjustably fixedly interconnected for movement into a plurality of different positions accommodating fastener packages in which the fasteners have a shank size different from the shank size of the fasteners of the other packages in the series. The selective adjustment can be accomplished relatively simply by disengaging a toggle latch assembly 86 and readjusting the position of the fastener package supporting part 48 with respect to the mounting part 46. After the readjustment, the fixed securement is accomplished by again locking the latch assembly.

Once the adjustment for the particular fastener package to be utilized has been made, replenishment can be easily and conveniently accomplished simply by releasing the latch—42 and enabling the door structure 38 and package covering part 50 of the canister to be swung into their open positions, enabling the new fastener package to be easily fed into operative position after which the parts are moved into their closed position and the latch 40–42 is closed.

Thus, the present canister assembly achieves both simple and convenient fastener package replacement and overall canister assembly size adjustment commensurate with the adjustment to accommodate the fastener package size. Moreover, these advantages are achieved while at the same time securing a highly desirable wide range of adjustment. The wide range of adjustment provided which, as previously indicated is from $1\frac{3}{4}$ to 4 inches, not only permits a wide range of fastener package sizes to be accommodated for a given tool, but, in addition, enables a single canister assembly to accommodate a series of different size tools, as, for example, four different size tools which range in weight and nail size accommodation as follows: (1) a tool weighing 7.6 pounds accommodating nail sizes of from $1\frac{3}{4}$ to $2\frac{3}{4}$ inches, (2) an 8 pound tool accommodating nail sizes of from 2 to $3\frac{1}{4}$ inches, (3) a 10.1 pound tool accommodating nail sizes of from $2\frac{1}{4}$ to $3\frac{1}{2}$ inches, and (4) a 10.6 pound tool accommodating nail sizes of from $2\frac{3}{4}$ to 4 inches. When it is considered that these tool weights are exclusive of the fastener load which can vary from 1.8 pounds, $1\frac{3}{4}$ inches to approximately 3 pounds, 4 inches, it can be seen the larger sizes substantial weights are required to be handled by the canister assembly. Moreover, these greater weights are required when the adjustment has been extended toward its larger limit. The provision of a plurality of interengaging ledges provides the strength necessary to accommodate this larger range of adjustment.

In these larger sizes damage of the canister assembly by accidental dropping of the tool can readily occur. With the present arrangement the shape and position of the abutments 84 in relation to position and spring press nature of the toggle latch enables fastener package supporting part 48 of the present canister assembly to separate from the remaining parts when the canister assembly is subjected to unwanted and unusual impact forces as may be caused when the tool is accidentally dropped.

It thus will be seen that the objects of this invention have been fully and effectively accomplished. It will be realized, however, that the foregoing preferred specific embodiment has been shown and described for the purpose of illustrating the functional and structural principles of this invention and is subject to change without departure from such principles. Therefore, this invention includes all modifications encompassed within the spirit and scope of the following claims.

What is claimed is:

1. A fastener driving tool comprising a housing, a magazine canister assembly carried by said housing for containing a coiled fastener package, means for feeding successive leading fasteners of the package into predetermined position to be driven and means for driving successive fasteners from said predetermined position into a workpiece, the improvement which comrpises said canister assembly comprising a mounting part, a package supporting part and a package covering part adjustably interrelated with respect to one another so as to contain a selected one of a series of coiled fastener packages, in which the fasteners of each coiled package are of incrementally different lengths with respect to the fasteners of the remaining packages of the series;

means for fixedly mounting said mounting part on said tool housing, said package supporting part including a generally circular fastener point engaging bottom wall and integral peripheral wall means extending in an axial direction with respect to the axis of said circular bottom wall from a substantial portion of the exterior periphery of said bottom wall, selectively operable means acting between the exterior periphery of a portion of said peripheral wall means and said mounting part for releasably fixedly supporting said package supporting part on said mounting part in a selected on of a plurality of different operative positions depending upon the nail size of the package which is selected for containment, said package supporting part being displaced with respect to said mounting part in the axial direction with respect to the axis of said circular bottom wall in parallel relation to itself in said plurality of different operating positions, means for supporting said package covering part on said mounting part for movement between (1) an operative position overlying the bottom wall of said package supporting part in any of its selected operative positions so as to contain the corresponding selected package in point supported relation on the bottom wall and within the peripheral confinement of the peripheral wall means of the package supporting part and (2) an access position wherein the space overlying the bottom wall is sufficiently open to permit movement of the package into point supported relation to the bottom wall within the peripheral wall means of said package supporting part, and means for releasably locking said package covering part in said operative position.

2. The improvement as defined in claim 1 wherein said selectively operable means comprises a series of axially spaced concavely arcuately extending supporting ledges formed on said mounting part and a plurality of spaced convexly arcuately extending supporting ledges formed on the peripheral wall means of said package supporting part, said ledges having a cross sectional configuration similar to meshing gear teeth so as to enable the plurality of ledges of said package supporting part to be selectively intermeshed between any corresponding plurality of ledges among the series of ledges on said mounting part.

3. The improvement as defined in claim 2 wherein the arcuate extent of said ledges is approximately 180°.

4. The improvement as defined in claim 2 wherein said bottom wall includes a point engaging surface extending in a plane generally perpendicular to the axis of said bottom wall.

5. The improvement as defined in claim 4 wherein said botton wall is formed with a center post extending axially from the center of said point engaging surface in the direction of axial extent of said peripheral wall means.

6. The improvement as defined in claim 2 wherein said peripheral wall means comprises a single peripheral wall extending throughout approximately 340° of the periphery of said bottom wall.

7. The improvement as defined in claim 6 wherein the portion of said peripheral wall means on which said plurality of ledges are formed has an axial extent greater than the axial extent of the remainder of said peripheral wall means.

8. The improvement as defined in claim 7 wherein the plurality of ledges is formed in the axial extent of said peripheral wall portion extending axially beyond the axial extent of the remainder of said peripheral wall means.

9. The improvement as defined in claim 2 wherein said selectively operable means further includes recess and abutment means adjacent one end of all of said ledges selectively interengageable when said ledges are intermeshed as aforesaid, releasable latch means carried by one of said parts adjacent the opposite end of the ledges thereof, and latch engaging means carried by the other of said parts adjacent the opposite end of the ledges thereof for engagement by said latch means when said ledges are intermeshed and said recess and abutment means are interengaged to retain the same therein.

10. The improvement as defined in claim 9 wherein said recess and abutment means includes a series of recesses between the ledges on said mounting part and a plurality of abutments extending from the ledges on said package supporting part.

11. The improvement as defined in claim 9 wherein said latch means comprises a first latch member having a hooked end and a second latch member having a manually engageable end, means for pivotally mounting the opposite end of said second latch member on said mounting part and means for pivotally mounting the opposite end of said first latch member to said second latch member intermediate the ends thereof, said latch engaging means including an axially extending latch engaging portion having a constant cross sectional configuration throughout its axial extent complementary with the hooked end of said latch member.

12. The improvement as defined in claim 1 wherein said package covering part includes spring means operable when the latter is in its operative position to engage the fastener package and resiliently bias tne point end thereof into engagement with said bottom wall.

13. The improvement as defined in claim 12 wherein said package covering part supporting means comprises integral hinge portions molded on said package covering part and said mounting parts respectively and a hinge pin pivotally interconnecting said hinge portions about an axis spaced from and extending at an angle to the axis of said bottom wall.

14. The improvement as defined in claim 12 wherein all of said parts are molded of plastic material.

15. The improvement as defined in claim 14 wherein said spring means constitutes an integral portion of the package covering part molded of plastic material.

* * * * *